US006735916B2

(12) United States Patent
Peshkam et al.

(10) Patent No.: US 6,735,916 B2
(45) Date of Patent: May 18, 2004

(54) REINFORCED STRUCTURAL MEMBER

(75) Inventors: Vahigh Peshkam, Diamond Bar, CA (US); Polycarp Samuel Fashole-Luke, Surrey (GB); Michael Brettargh Leeming, London (GB); Henrik Thorning, Kolding (DK); Eric Syndergaard Knudsen, Kolding (DK)

(73) Assignees: Mouchel Consulting Limited, Surrey (GB); Fiberline Composites A/S, Kolding (DK)

( * ) Notice: Subject to any disclaimer, the term of this patent is extended or adjusted under 35 U.S.C. 154(b) by 41 days.

(21) Appl. No.: 09/801,047

(22) Filed: Mar. 8, 2001

(65) Prior Publication Data

US 2001/0032430 A1 Oct. 25, 2001

Related U.S. Application Data

(63) Continuation-in-part of application No. 09/285,779, filed on Apr. 5, 1999, now Pat. No. 6,226,944, which is a continuation-in-part of application No. 08/409,465, filed on Mar. 24, 1995, now abandoned.

(30) Foreign Application Priority Data

Mar. 25, 1994 (GB) ..... 9405982

(51) Int. Cl.[7] ..... E04C 3/28
(52) U.S. Cl. ..... 52/650.1; 52/309.1; 52/737.6
(58) Field of Search ..... 52/648.1, 650.1, 52/654.1, 720.1, 737.6, 732.1, 731.2, 731.1, 731.4, 731.7, 731.8, 732.3, 606, 609, 724.3, 724.1, 724.4, 309.1

(56) References Cited

U.S. PATENT DOCUMENTS

| | | | | |
|---|---|---|---|---|
| 236,504 A | * | 1/1881 | Lyons | 52/606 |
| 374,271 A | | 12/1887 | Rodemer | |
| 596,217 A | | 12/1897 | Rapp | |
| 764,772 A | | 7/1904 | Rydahl | |
| 778,416 A | | 12/1904 | Kyle | |
| 1,463,759 A | * | 7/1923 | Carson et al. | 52/609 |

(List continued on next page.)

FOREIGN PATENT DOCUMENTS

| | | |
|---|---|---|
| DE | 1965272 | 7/1971 |
| DE | 3115760 | 3/1983 |
| DE | 3307753 | 9/1983 |
| DE | 8811686 | 12/1988 |
| GB | 2 115 452 | 9/1983 |
| JP | 50-38193 | 11/1975 |
| JP | 53-27225 | 3/1978 |
| JP | 58-80046 | 5/1983 |
| JP | 50-119417 | 7/1990 |
| WO | WO93/19261 | 9/1993 |
| WO | WO93/24714 | 12/1993 |

*Primary Examiner*—Michael Safavi
(74) *Attorney, Agent, or Firm*—Nixon & Vanderhye P.C.

(57) ABSTRACT

An elongate structural member comprising a structural outer shell and at least one arcuate or diagonal reinforcing member within. The structural member is used in structural, semi-structural or cladding applications to carry floor loading, walkway loading, wheeled loading, pressure loading in buildings, bridges and other loading carrying applications. An elongate structural member has an outer shell formed by first and second flanges joined to first and second external webs to have a cross-section in the form of a parallelogram. The first and second external webs are mutually parallel and inclined at an acute angle to the first and second flanges with the flanges being mutually parallel. At least one reinforcing web extends between the first and second flanges within said outer shell. The reinforcing web or webs are inclined to the flanges at the same acute angle as the first and second external webs but in the opposite direction. The structural member is made of a composite material comprising long fibers embedded in a polymeric matrix.

9 Claims, 13 Drawing Sheets

U.S. PATENT DOCUMENTS

| | | | | |
|---|---|---|---|---|
| 1,568,252 | A | | 1/1926 | Strub |
| 1,990,001 | A | | 2/1935 | Rutten et al. |
| 2,104,585 | A | * | 1/1938 | Dow et al. ..... 52/609 |
| 2,116,886 | A | | 5/1938 | Goetz |
| 2,362,162 | A | | 11/1944 | Sheldon |
| 3,113,401 | A | | 12/1963 | Rose |
| 3,296,767 | A | * | 1/1967 | Lebowitz ..... 52/650.1 |
| 3,331,177 | A | | 7/1967 | Godfrey et al. |
| 3,386,218 | A | | 6/1968 | Scott |
| 3,427,773 | A | | 2/1969 | Kandall |
| 3,727,362 | A | | 4/1973 | Ellison et al. |
| 4,030,265 | A | | 6/1977 | Allgood |
| 4,181,556 | A | | 1/1980 | Fehlmann |
| 4,538,392 | A | | 9/1985 | Hamar et al. |
| 4,795,666 | A | | 1/1989 | Okada et al. |
| 4,843,777 | A | | 7/1989 | Shimabukuro |
| 4,856,256 | A | | 8/1989 | Tokuzo |
| 5,102,710 | A | | 4/1992 | Kaufman et al. |
| 5,348,778 | A | | 9/1994 | Knipp et al. |

* cited by examiner

REINFORCED STRUCTURAL MEMBER

CROSS-REFERENCE TO RELATED APPLICATIONS

This application is a continuation-in-part of application Ser. No. 09/285,779 filed Apr. 5 1999, now U.S. Pat. No. 6,226,944, which is a continuation-in-part of application Ser. No. 08/409,465 filed Mar. 24, 1995, now abandoned.

BACKGROUND OF THE INVENTION

The present invention relates to a reinforced structural member for use in applications where load carrying capability is required, for example structural, semi-structural and cladding applications to carry floor loading, walkway loading, wheeled loading, pressure loading in buildings, bridges etc.

Traditionally, solid members have been used in the above applications. Recently sectioned members have been proposed but these are mainly box-section members such as those described in WO 91/06421.

BRIEF SUMMARY OF THE INVENTION

The present invention provides an elongate structural member comprising an outer shell having a quadrilateral lateral cross section with opposite faces substantially parallel and at least one reinforcing member within the outer shell.

The reinforcing member may be arcuate in a plane perpendicular to the axis of said structural member and extend between positions near opposite edges of one major face of the outer shell. The mid section of the reinforcing member then approaches near the opposite face.

Alternatively, the reinforcing member may be straight and extend between the major faces of the outer shell. Where the outer shell is not rectangular in cross-section, i.e. the minor faces are not perpendicular to the major faces, it is particularly preferred that some or all of the reinforcing members are oppositely inclined to the minor faces. A particularly strong structure which is simple to manufacture can be formed by arranging a single internal reinforcing member which is oppositely inclined to the minor faces of the outer shell and extends generally along the shorter diameter of the shape formed by the outer shell in cross-section.

The present invention provides a member which has improved strength characteristics by efficiently transmitting loads to the bottom corners or intermediate points across the section, while providing stiffness in the longitudinal direction, preventing local buckling of the wide upper flange and resistance to in-plane loading.

It is envisaged that the space between the arcuate member and the load bearing surface opposing the arcuate surface may be filled with a foam material and/or may have rib members extending between them.

Both the outer shell and the arcuate member may be constructed by either molding or pultruding them from fiber reinforced composite materials. This provides the member with the strength required whilst retaining a lightweight construction.

When load is applied to the load bearing surface, it is passed through the arch to the base of the structural member where it is transmitted to the supports at suitable points along the length of the member. In order to prevent the ends of the arch from splaying outwards they are restrained in one of two ways. Either, a planar sheet of a similar material to the rest of the outer shell is used to restrain the ends of the arch and also forms the base of the structural member or tension members such as wires or strips are provided spaced along the length of the structural member connecting the opposite sides of the arch to hold them in position.

It is also envisaged that to provide improved performance especially when high in-plane forces are encountered, reverse arching may be used. In such instances the structural member would contain two intersecting arcuate members, one hogging and one sagging. This also allows the member to be used either way up, avoiding the need to check which way up the arcuate member is within the outer member when positioning the member.

If the structural members are to be used in combination, connecting portions may be provided to allow attachment of the units to each other to form floors, decks, roofs, walls, beams and columns of buildings, bridges and other forms of structure.

If the structural members are to be suspended in use then hanger portions may be provided to allow attachment to the hanging means.

BRIEF DESCRIPTION OF THE DRAWINGS

The present invention will be further described hereinafter with reference to the following description of exemplary embodiments and the accompanying drawings, in which.

In the figures, like parts are indicated by like reference numerals.

DETAILED DESCRIPTION OF PREFERRED EMBODIMENTS OF THE INVENTION

Figure 1:
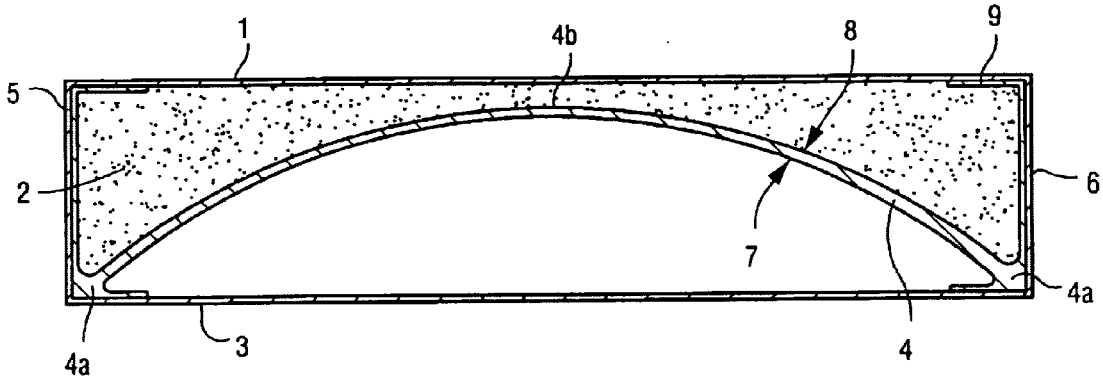
FIG. 1 shows an example of the basic configuration having foam filled spandrels.

FIG. 1 shows the basic configuration of a first embodiment of the present invention. The structural member comprises an outer member consisting of the load bearing surface 1, two side faces 5 and 6, a fourth face 3, and an arcuate member 4. Load applied to the structural member is passed through the load bearing surface 1 to the upper surface of the arcuate member 4. The load is supported by the strength of the arch and is passed to the ends 4*a*. As load is applied to the arch there is a tendency for the ends 4*a* to splay out unless they are restrained. Such a restraining force is provided, in use, by the fourth face 3 which holds the ends of the arch together and hence holds the arch in shape.

The space 2 defined between the convex surface 8 and the inside of the load bearing surface is filled with a foam material to help to distribute the load evenly to the arcuate member.

The arcuate member 4 may be formed as a single unit with the outer member (1,3,5,6) or formed separately and inserted into the outer member subsequently. Reinforcements 9 may also be used in the corners of the outer member to increase the overall stiffness and strength of the structural member. The reinforcement may be formed as part of the outer shell, part of the arcuate member or formed as a separate entity to be inserted into the outer member. The outer shell and arcuate member may have a laminated structure or be formed in a single piece.

Figure 2:
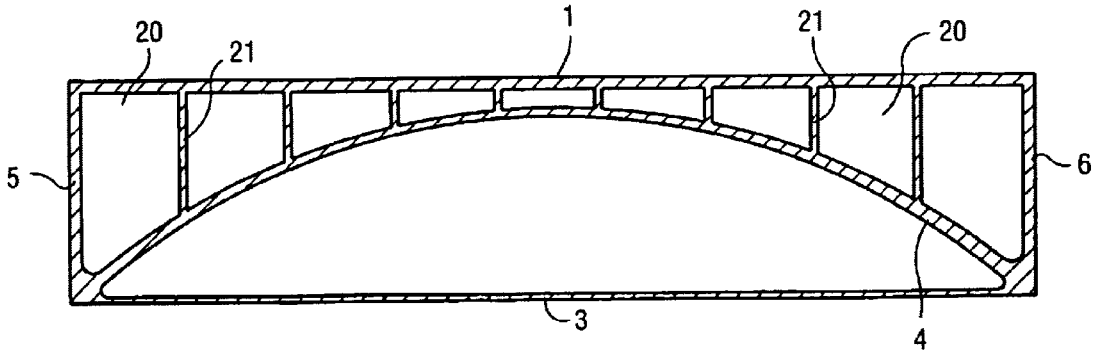
FIG. 2 shows the basic configuration with reinforcing ribs provided between the arch and the load bearing surface.

The structural member may also be constructed with or without a foam filling in the space 2 by using reinforcing ribs 21 to distribute the load onto the arcuate member, as shown in FIG. 2. The ribs may extend parallel to the axis of the structural member and perpendicular to the load bearing surface as in FIG. 2. However it is envisaged that there may be alternative ways of arranging the ribs, for example a fan like arrangement where the ribs are parallel to the axis of the structural member and perpendicular to a tangent at the point of intersection with the arcuate member.

Figure 3:
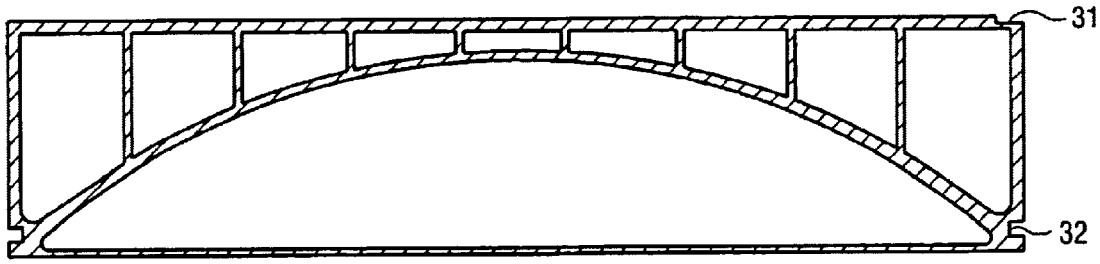
FIG. 3 shows the embodiment of FIG. 2 with hanger and connection portions for hanging and connecting the members in use.

The structural members may also be used by resting them on supports or by hanging them from a hanging means such as wires. To this end the structural members may be provided with hanging portions 31 and 32 as shown in FIG. 3 to allow attachment to such a hanging means.

Figure 4:
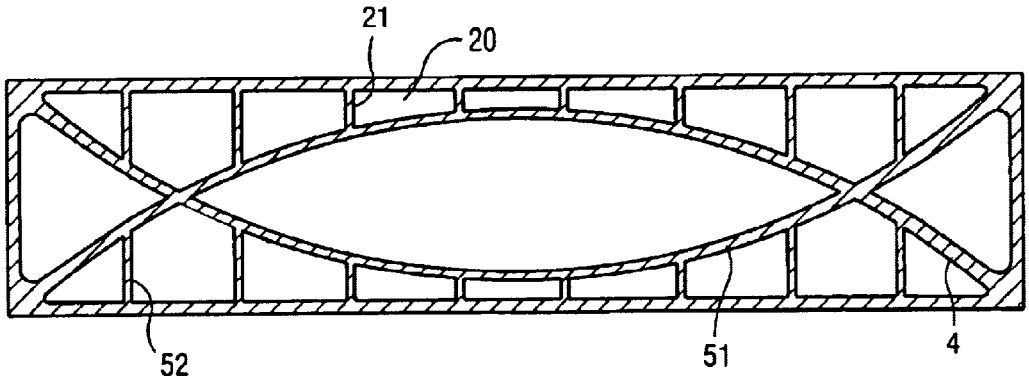
FIG. 4 shows a further embodiment having two intersecting arches.

FIG. 4 shows an alternative construction of the present invention comprising two arcuate members which intersect each other. The second arcuate member 51 is curved in the opposite sense to the other arcuate member 4. Extra ribs 21 and 52 may be included similarly to the ribs 21 shown in FIG. 2. As with previous embodiments the spaces between the ribs may be filled with a foam material. Alternatively some or all of the ribs may be excluded completely whilst still using the foam filler as in the configuration shown for a single arch in FIG. 1.

In use the structural member may be used with several similar members adjacent to it to form a floor or deck and so on. They may also be configured with adjacent members perpendicular or at inclined angles. To accommodate this, connection portions 41–44 as shown in FIGS. 5 & 6 may be included to facilitate connection to adjacent structural members or to inter-connect members as described below.

Figure 5:
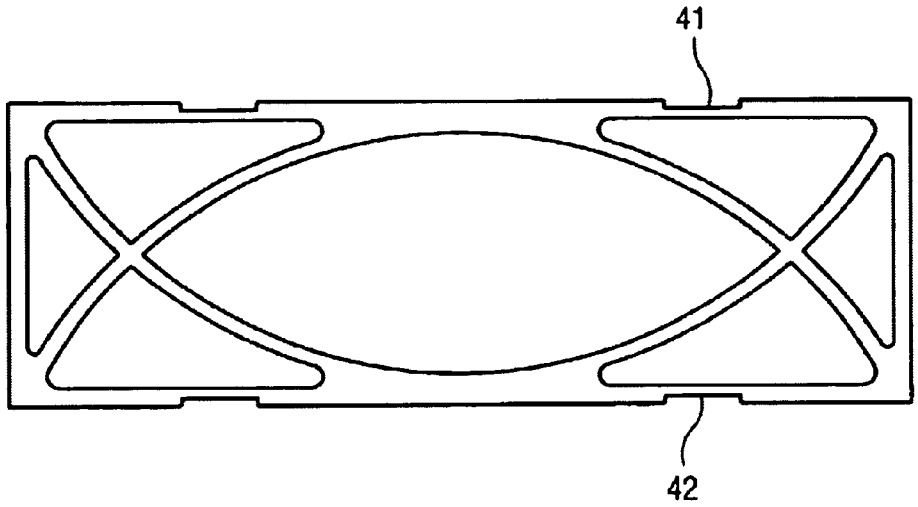
FIGS. 5 and 6 show two embodiments with two intersecting arches having the different connection portions.
Figure 6:
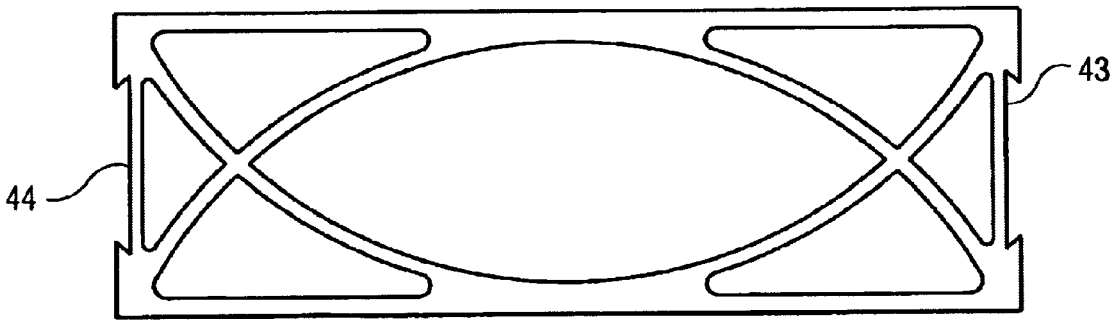
Figure 7:
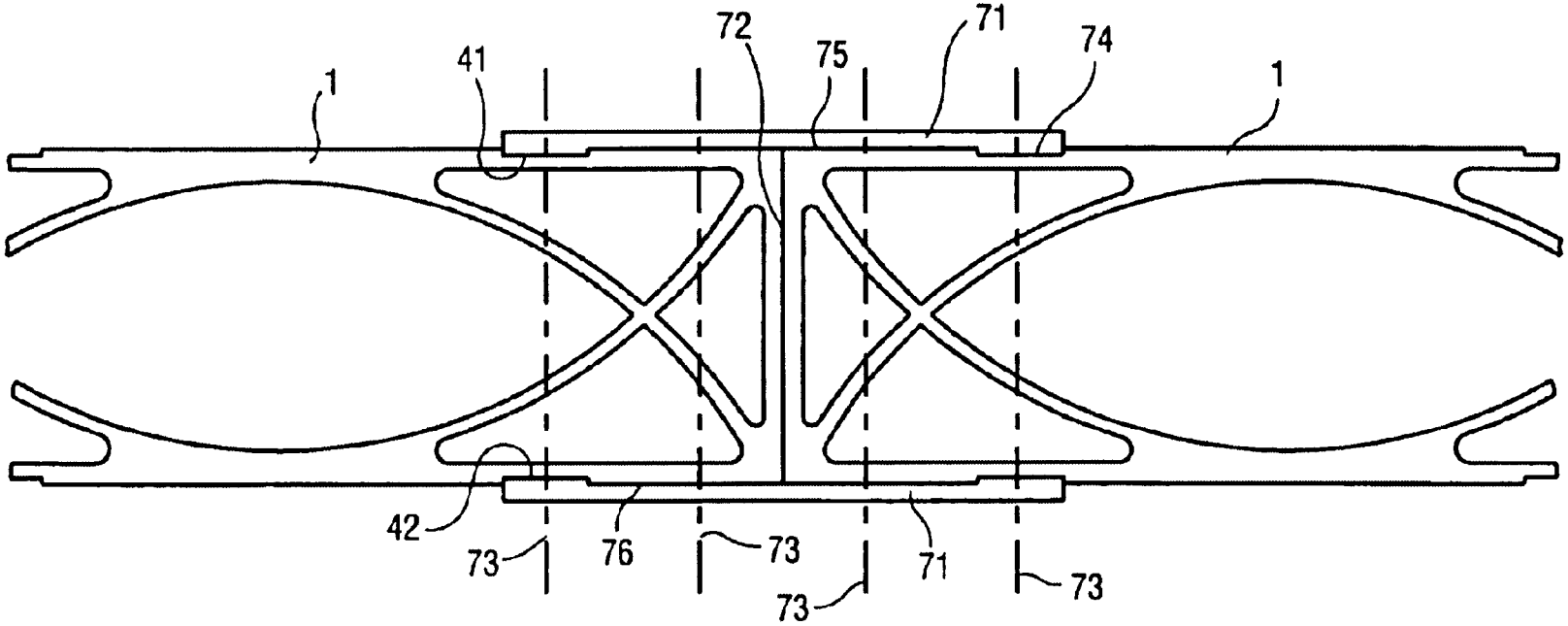
FIG. 7 shows a detailed view of the connection of two members using the first type of connection member.

FIG. 7 shows an example of two of the members shown in FIG. 5 connected together by connection members 71. The connection members have outstanding portions 74 which are shaped to engage the recess portions 41 provided on the structural member. The two members to be connected are bonded together along their abutting surfaces 72 and to the connection members along interfaces 75 and 76. It is also envisaged that the connecting members will be connected to each other via a web portion (not shown) which runs between the edges of the members 1. Then in order to join members, the two members are slid into each side of the connecting member until the outstanding portions 74 engage the recess portions 41 such that the edge faces of the members abut against the web portion. In such a construction the edges of the members are bonded to the web portion as opposed to each other, as in the previous construction. In order to increase the strength of the joint a bolt may be passed through the connection members and the structural members to clamp the parts together. The possible positions of the bolts are indicated by dashed lines 73 in FIG. 7.

Figure 8:
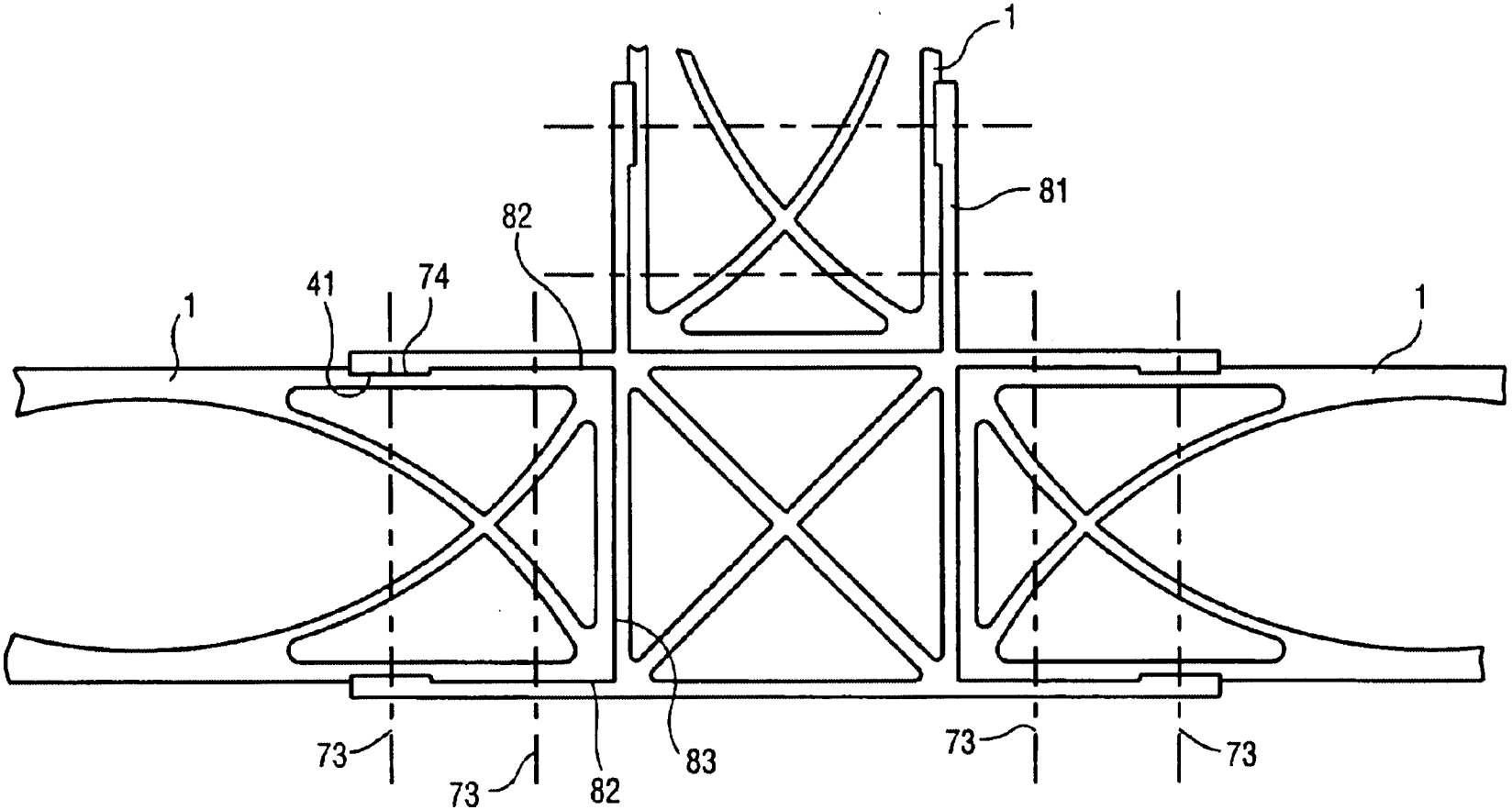
FIG. 8 shows a detailed view of the connection of three members using a T-shaped configuration of the first type of connection member.
Figure 9A:
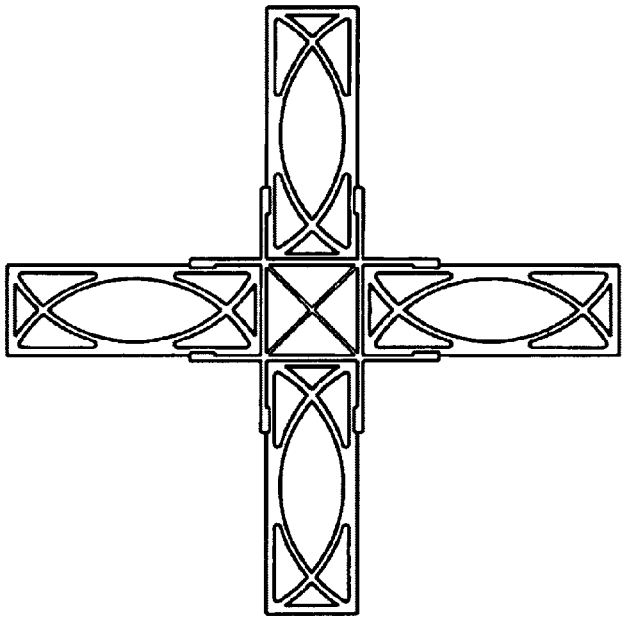
FIGS. 9A–D shows four possible modes of connection using four different configurations of the first type of connection member.
Figure 9B:
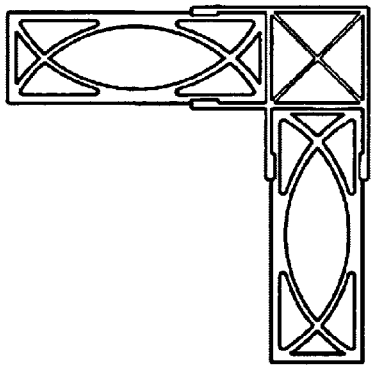
Figure 9C:
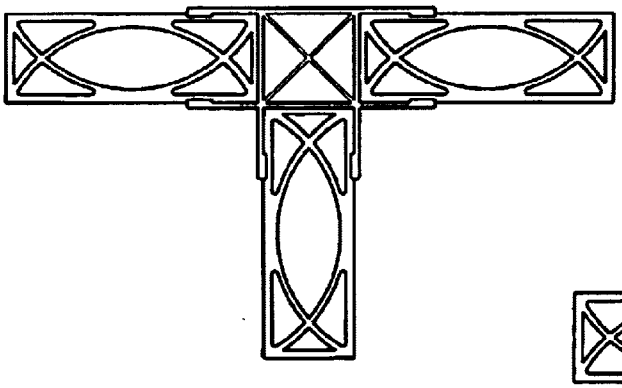
Figure 9D:
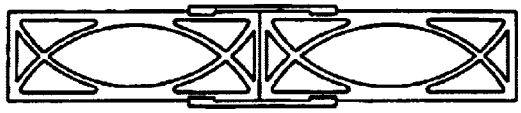

FIG. 8 shows an example of a connection member for connecting three structural numbers of the type shown in FIG. 5. Again each of the three structural members is inserted into the D-shaped connection member to which they are subsequently bonded along the member's edge 83 and upper and lower 82 surfaces.

FIGS. 9A to 9D illustrate the various forms of connection member usable with the first connection system. This includes the cross junction of FIG. 9A, corner junction of FIG. 9B, T-junction of FIG. 9C and a series junction of FIG. 9D.

Figure 10:
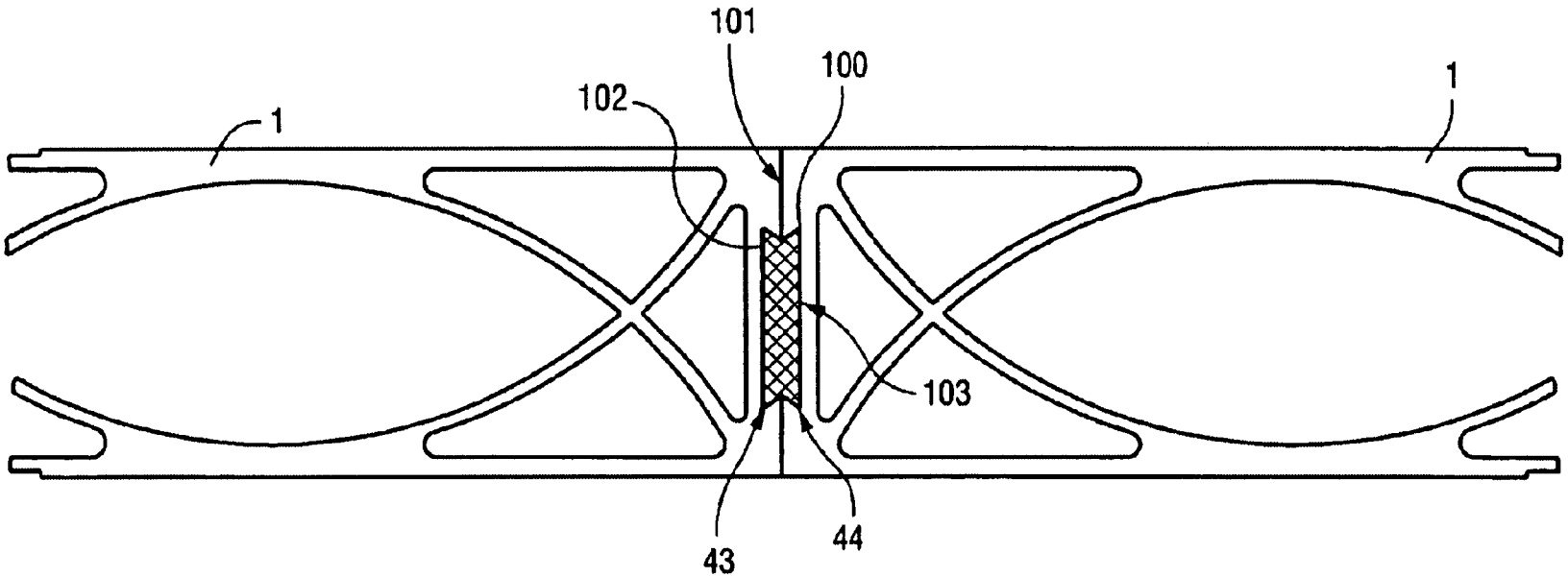
FIG. 10 shows a detailed view of the connection of members using a second type of connection member.

As shown in FIG. 10, a connection method for the embodiments shown in FIG. 6 comprises undercut recesses 43, 44 into which is inserted a connection member 100 having overhanging portions 102 adapted to engage the recess portions 43, 44 to retain the connection member in the slot. By inserting the similarly overhanging portion on the opposite side of the connecting member to the undercut recess slot of another member it is possible to hold two members together. When the two members to be connected are engaged with the connecting member, their edge faces come into abutting contact. The contacting surfaces 101 and 103 are then bonded to provide a permanent connection.

Figure 11:
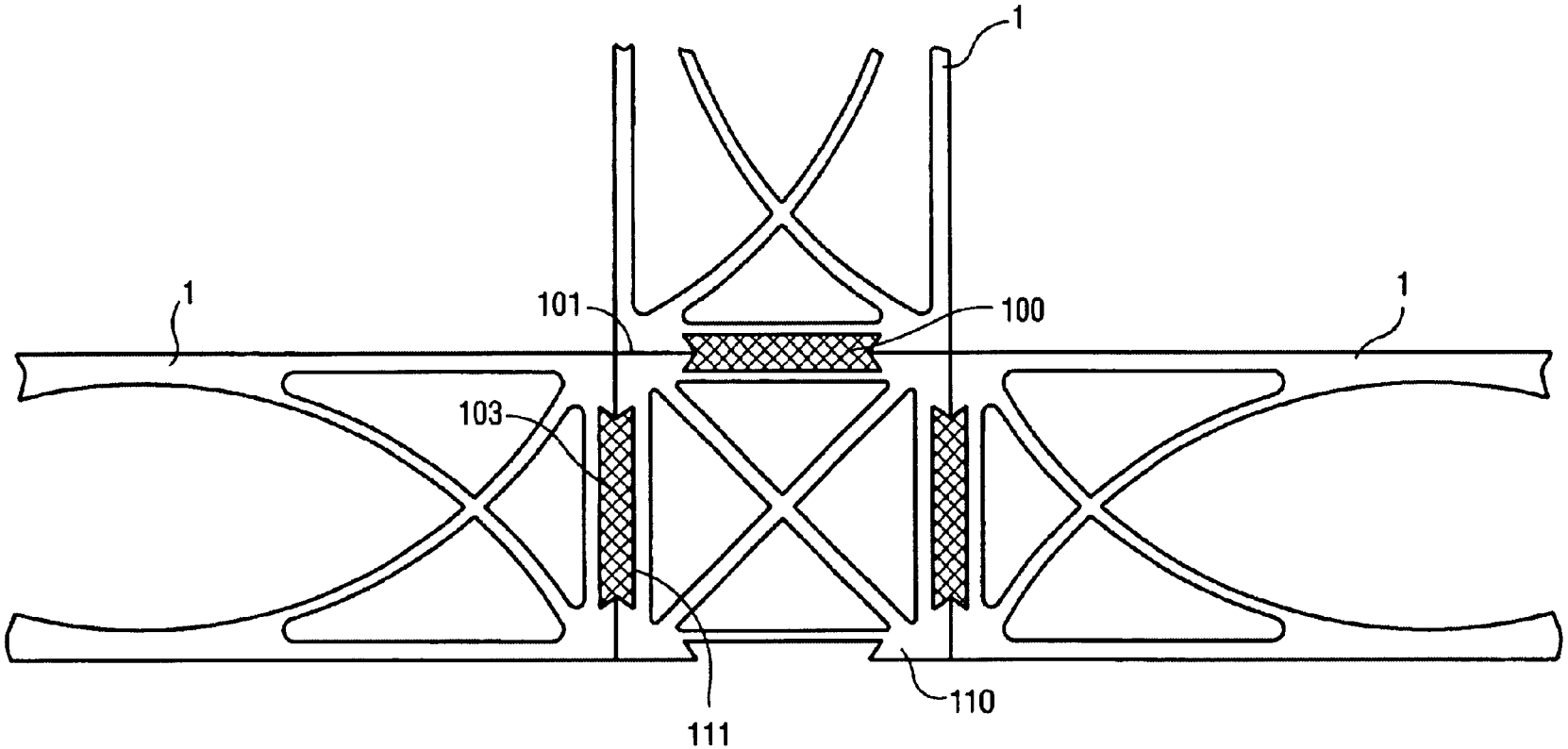
FIG. 11 shows a detailed view of the connection of three members using the second type of connection member and using an inter-connect piece.
Figure 12A:
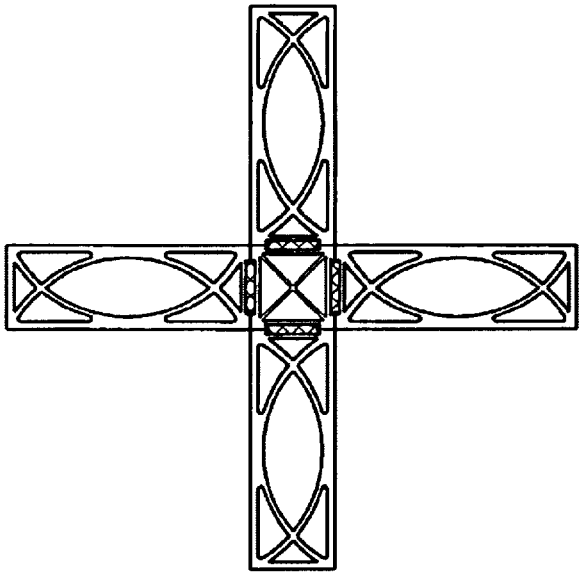
FIGS. 12A–D shows four possible modes of connection using the second type of connection means.
Figure 12B:
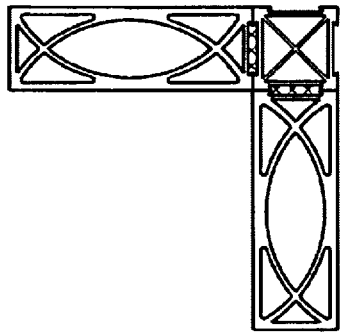
Figure 12C:
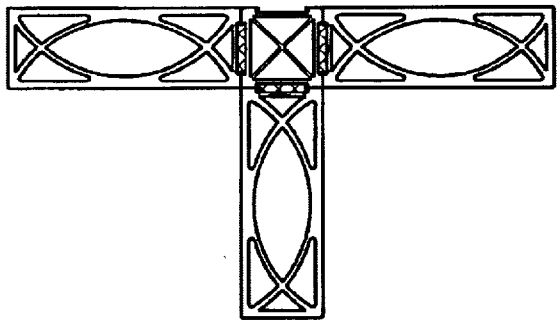
Figure 12D:
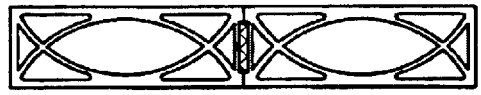

It is possible to connect the structural members in a T-junction format using an interconnect member 110 having undercut slots 111 similar to those on the structural members 1 to engage with the connecting members 100. FIG. 11 shows a typical construction of a T-junction using the connection members 100 and the interconnect member 110.

Again use of such an interface member allows various different configurations for joining the members (1) together. These are shown in FIGS. 12A to 12D corresponding to FIGS. 9A to 9D.

Figure 13:
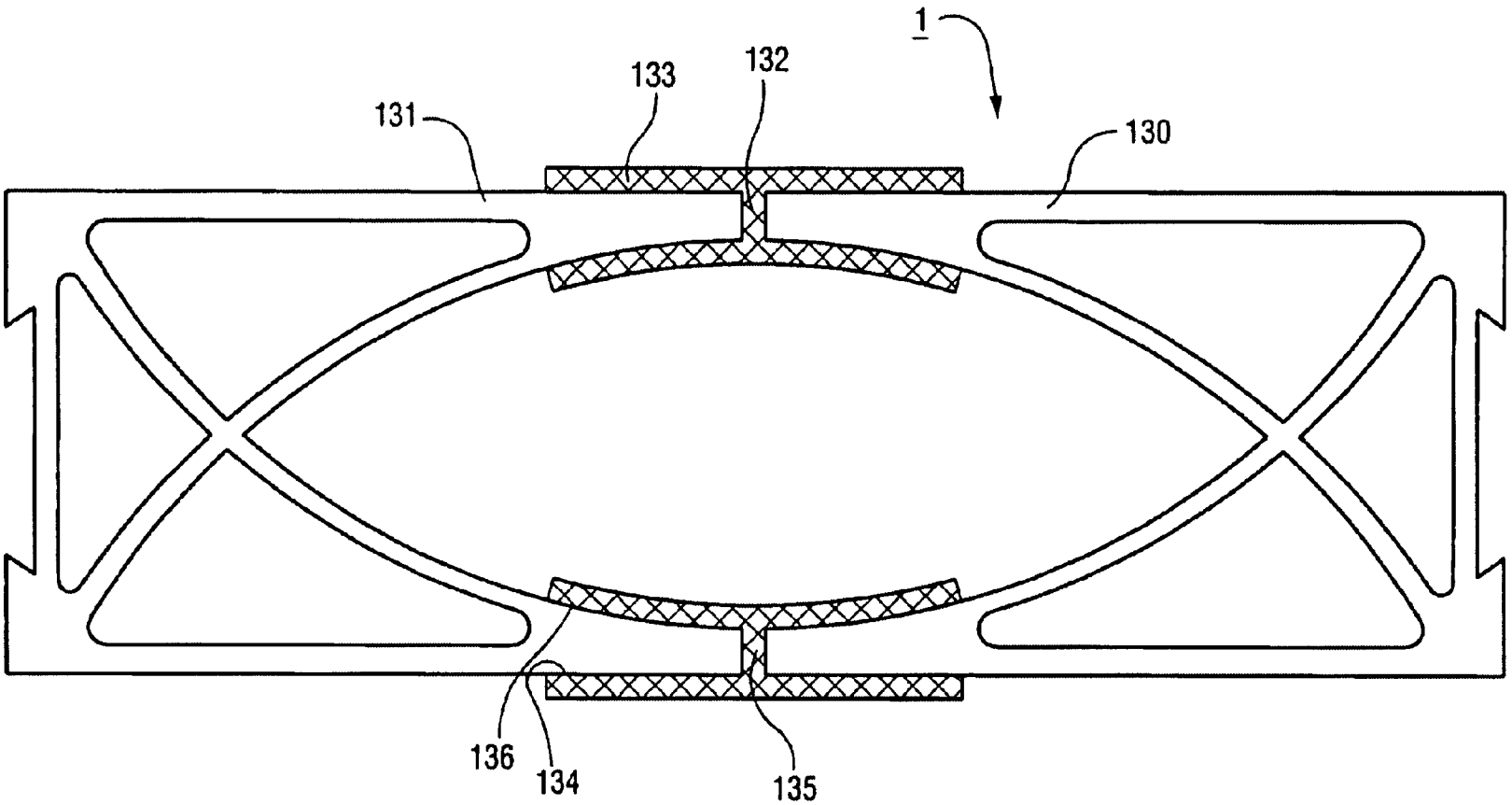
FIG. 13 shows a member according to the present invention formed in two-parts and bonded via a bonding member.

The structural members according to the present invention may be constructed in a number of different ways. For example the FIG. 1 construction has the outer shell and the arcuate member constructed separately, the arcuate member then being inserted into the outer shell on construction. Alternatively the members may be formed in a single stage by molding or pultruding them from fiber reinforced composite materials. Another method of construction is shown in FIG. 13 where the structural member is formed in two halves 130, 131 which are then either bonded together directly or, as shown in FIG. 13 bonded via a bonding member 132. The bonding member having a web portion 135 against which the edges of the halves of the structural member 130, 131 are abutted, and flange members 133 which also abut against the inside 136 and outside 134 surfaces of the halves 130, 131 of the structural member. The two halves and the bonding members are then bonded together at these contact surfaces to form the structural member.

Figure 14:
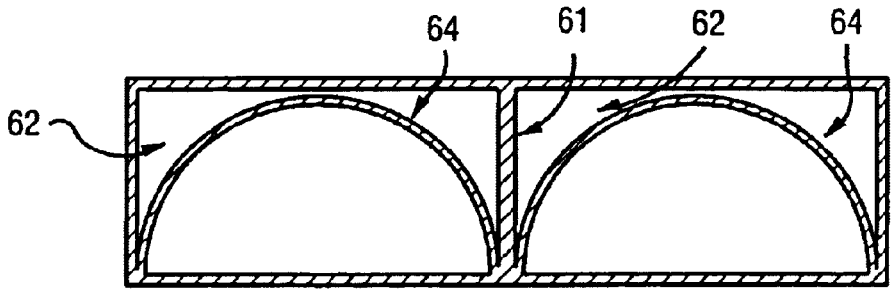
FIG. 14 shows a multi-cellular embodiment of the present invention.

A further embodiment of the present invention is shown in FIG. 14. This figure shows a multicellular structural member comprising two arcuate members 64 within a single outer member although it is envisaged that three or more arcuate members may be used. The arcuate members may be separated by rib members 61 as shown in FIG. 6. Again the spaces 62 may be filled with a foam material and/or have rib members 21 to distribute the load.

Figure 15:
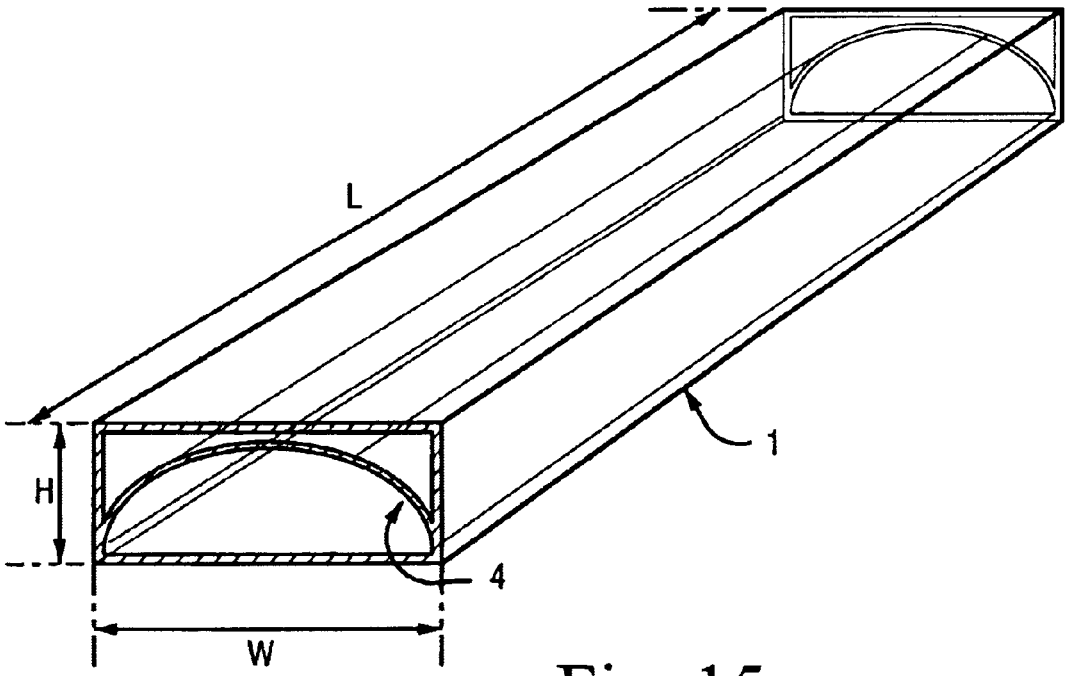
FIG. 15 is a prospective view of a structural member according to the invention showing its dimensions.

As shown in FIG. 15 the structural member of the present invention is considerably wider than it is tall and considerably longer than it is wide. In a preferred embodiment the height (thickness) (from the face spanning the open side of the arcuate member to the face approached by the apex of the arcuate member) to width (across the open side of the arcuate member) aspect ratio H:W is in the range of 1:2 to 1:3, preferably 1:2:5. The width to length aspect ration, W:L, is 1 to 2.5 or longer. Presently preferred embodiments have dimensions of 600 mm (width)×250 mm (height) or 900 mm (width)×330mm height) and length 2500 mm or more.

It will be appreciated that, although the basic single arch embodiment is illustrated in FIG. 15, the same dimensions and aspect ratios apply to the other variations described above.

All of the structural variants described above are preferably manufactured from an advanced composite material comprising a high modulus, high strength and high aspect ratio reinforcing material encapsulated by and acting in concert with a polymeric matrix. In preferred embodiments the reinforcing material comprises long fibers of one or more of E glass, R glass, carbon or aramid. The polymeric matrix comprises one or more of epoxy, vinyl ester, phenolic or isophthalic resins. The fibers occupy from 50% to 75%, preferably 65%, of the material by volume.

The structural member is preferably manufactured by a pultrusion or prepreg process and may be manufactured in continuous lengths which are subsequently cut to size.

In the major faces, top and bottom as shown in FIG. 15, from 65% to 95% of the fibers will be orientated longitudinally with the remainder at 90° and/or ±45° for the longitudinally axis. Of the longitudinal and lateral fibers 95% or more will extend the full length or width of the member. In the side (web) members and the arcuate member (s) from 20% to 80% will be oriented longitudinally with the remainder again at 90° and/or ±45°. Again, 95% or more of the fibers will extend to full length or width of the member. Other angles can also be used, depending on the loading to which the member will be subjected.

Figure 16:
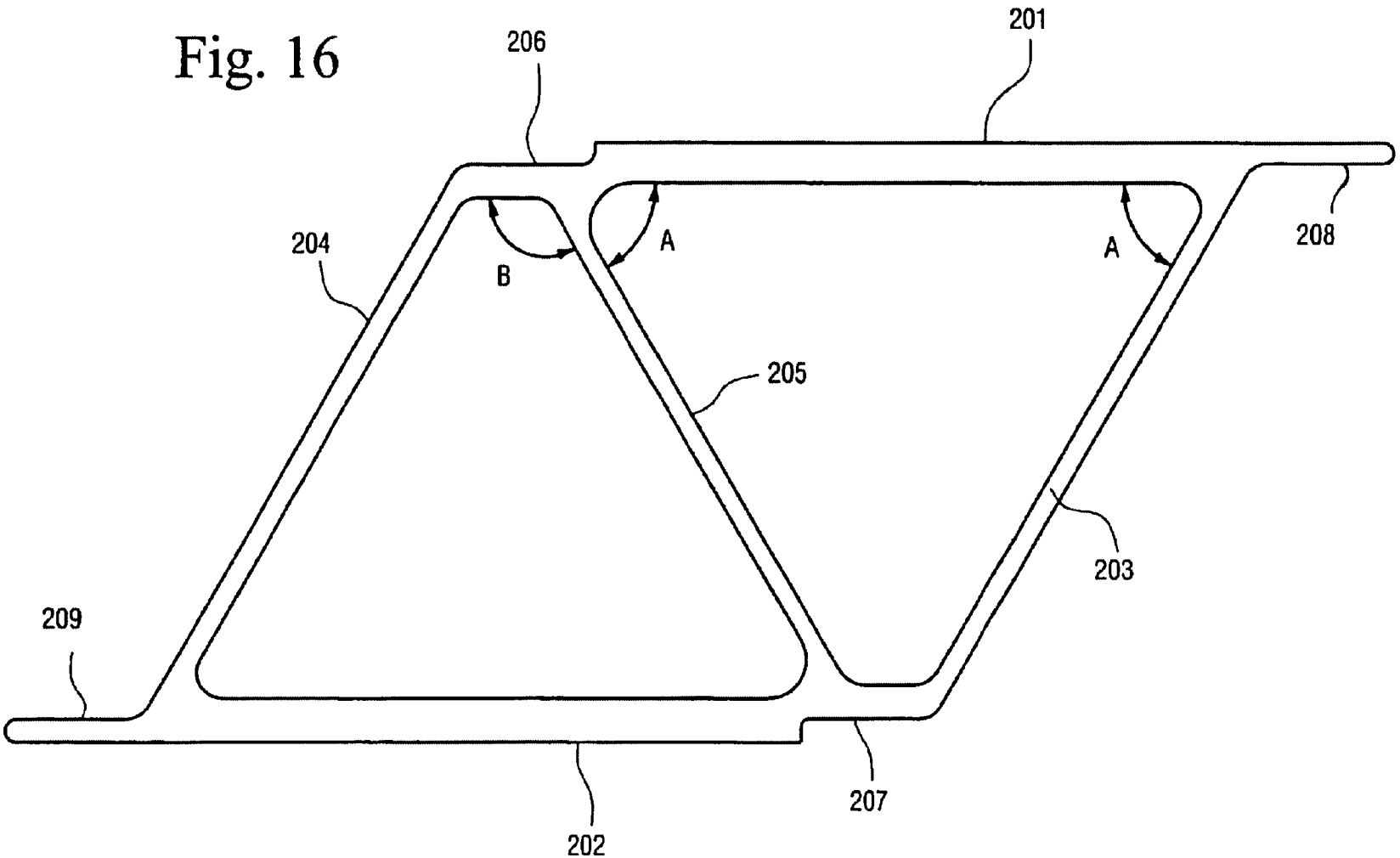
FIG. 16 is a cross-sectional view of a structural member according to the invention having a single diagonal reinforcing member.

FIG. 16 shows in cross-section another structural member according to a presently preferred embodiment of the present invention.

The structural member 200 comprises top and bottom flanges 201,202 which are made out of advanced composite materials including Glass Fibre Reinforced Polymer (GFRP) fibres in an isopolyester/isophthalic or vinyl ester resin, with a fibre volume fraction of 60–80% of fibres and 20–40% of resin matrix, determined according to the application to which the structural member is to be put. Additionally, Carbon Fibre Reinforced Polymer (CFRP) fibres may also be included in the range of from 1–20% by volume in order to increase the stiffness of the structural member. The fibres in the top and bottom flanges 201,202 include unidirectional fibres and multidirectional (off-axis) mats of sheets with fibres oriented at angles ranging from 0–90°. The unidirectional fibres are placed to resist longitudinal stresses and mats or sheets primarily to resist transverse effects although they will also contribute to resisting longitudinal stresses. The top and bottom flanges can be manufactured by a pultrusion process, e.g. in a closed system where the resin is injected into the pultruding dies to form the section. Open bath pultrusion can also be used. The top and bottom flanges 201,202 can thereby resist primarily tensile and compressive loads as a result of bending of the structural member.

The structural member further comprises three webs 203,204,205 joining the top and bottom flanges 201,202. The two external webs 203,204 are non-vertical and parallel to each other so that the outer shell of the structural member essentially takes the form of a parallelogram. The third web 205 is internal and also non-vertical. It is preferably inclined to the top and bottom flanges at the same angle as the external webs 203,204 but in the opposite direction so as to form a diagonal reinforcement extending between the top and bottom flanges at or near the closer corner of the parallelogram cross-section. The webs 203–205 are preferably made of advanced composite materials, including GFRP and/or CFRP fibres in a resin matrix. The proportion by volume of fibres and composition of the resin matrix may be similar to those of the top and bottom flanges 201,202. The webs are preferably pultruded as a unitary body with the flanges 201,202.

To assist in joining together structural members according to the invention, the top and bottom flanges 201,202 have along one edge a projecting tongue 208,209 of thickness approximately half that of the flanges 201,202 and along the other edge a corresponding groove 206,207. As shown in FIG. 16, the projecting tongues 208,209 project from the furthest apart corners of the cross-section of the structural member. The projecting tongues 208,209 and corresponding grooves 206,207 assist in glueing together adjacent structural members; these structural members are simply laid adjacent and held together to a fixed plan with the tongues engaging in the corresponding grooves and the geometry of the section then ensures that the structural members will be positioned and straight with a uniform thickness of adhesive layer, which may be spread on the tongue and groove and/or the external faces of the external webs 203,204.

The acute angle between the webs 203,204,205 and top and bottom flanges 201,202, illustrated at A in FIG. 16, is set at 60° so that the obtuse angle, shown at B, is 120°. This arrangement avoids stress concentrations at the internal corner which provides additional strength to resist heavy crosswise loadings. Further, the internal corners are all smoothly rounded, e.g. with a radius similar to the thickness of the flanges, to ensure that the off-axis reinforcement always follows the edge.

Figure 17:
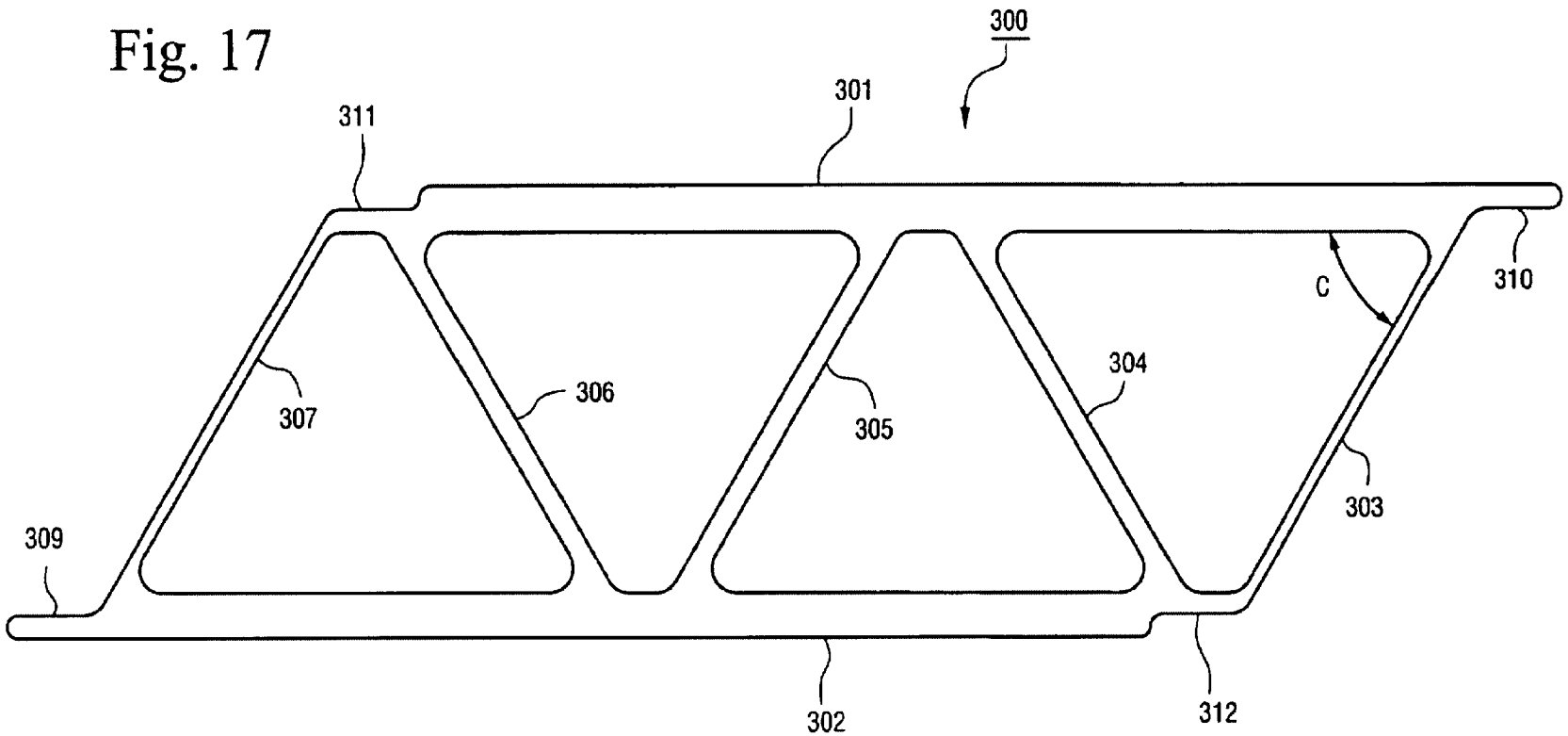
FIG. 17 is a cross-sectional view of a structural member according to the invention having three diagonal reinforcing members.

FIG. 17 shows another structural member according to a presently preferred embodiment of the invention.

The structural member 300 of FIG. 17 is similar to the structural member 200 of FIG. 16 but the top and bottom flanges 301,302 are wider and the structural member is provided with three internal reinforcing webs 304,305,306 as well as the external webs 303,307. The middle internal reinforcing web 305 is parallel to the external webs 303,307 whilst the other two internal reinforcing webs 304,306 are inclined to the flanges 301,302 at an equal angle but in the opposite direction. The profile of FIG. 17 essentially resembles a combination of two of the structural members 200 of FIG. 16 placed side-by-side.

Whilst we have described above specific embodiments of the invention, it will be appreciated that variations to these embodiments may be made and that the invention is not limited by the description but rather by the appended clams.

What is claimed is:

1. An elongate structural member comprising:

an outer shell formed by first and second flanges and first and second external webs joined to have a cross-section in the form of a parallelogram; said first and second external webs being substantially mutually parallel and inclined at an acute angle to said first and second flanges, which are substantially mutually parallel; and a reinforcing web extending between said first and second flanges within said outer shell, said reinforcing web being inclined to said flanges at the same acute angle as said first and second external webs but in the opposite direction;

said member being made of a composite material comprising long fibres embedded in a polymeric matrix.

2. A member according to claim 1 wherein said reinforcing web is joined to said first flange near to a first edge thereof at which said first external web is joined to said first flange and is joined to said second flange near to a first edge thereof at which said second external web is joined to said first flange.

3. A member according to claim 2 wherein said first flange is provided with a projecting tongue extending substantially parallel to said first flange from a second edge thereof opposite to the first edge of said first flange and a groove at said first edge for engagement with a projecting tongue of a like member.

4. A member according to claim 3 wherein said second flange is provided with a second projecting tongue at a second edge thereof opposite to the first edge of said second flange and a second groove at said first edge of said second flange.

5. A member according to claim 3, wherein said reinforcing web is joined to said first flange along a line spaced from said first edge of said first flange by a distance less than or equal to the width of said groove.

6. A member according to claim 4, wherein said reinforcing web is joined to said first flange along a line spaced from said first edge of said first flange by a distance less than or equal to the width of said groove and said reinforcing web is joined to said second flange along a line spaced from said first edge of said second flange by a distance less than or equal to the width of said second groove.

7. A member according to claim 1 wherein the joints between the webs and the flanges are rounded with a radius of from one half to twice the thickness of the flanges.

8. A member according to claim 1 wherein said acute angle is in the range of from 50 to 70 degrees.

9. A member according to claim 1 further comprising second and third reinforcing webs extending between said first and second flanges, said second reinforcing web being substantially parallel to said external webs and said third reinforcing web being substantially parallel to the first-mentioned reinforcing web, said second reinforcing web being positioned between the first-mentioned reinforcing web and the third reinforcing web.

* * * * *